US005955827A

United States Patent [19]

Short

[11] Patent Number: 5,955,827

[45] Date of Patent: Sep. 21, 1999

[54] SPARK PLUG WITH REPLACEABLE GROUND ELECTRODE

[76] Inventor: Robert Lee Short, 5325 S. Caballo Rd., Tucson, Ariz. 85746

[21] Appl. No.: 08/703,814

[22] Filed: Aug. 27, 1996

[51] Int. Cl.[6] ..... H01T 13/20; H01T 13/24; H01T 13/46; H01T 13/14

[52] U.S. Cl. ..... 313/141; 313/123; 313/122; 313/128

[58] Field of Search ..... 313/122, 123, 313/125, 128, 135, 139, 141, 144; 123/169 EB, 169 EC, 169 R

[56] References Cited

U.S. PATENT DOCUMENTS

| | | | |
|---|---|---|---|
| 1,489,454 | 4/1924 | Osterhout | 313/122 |
| 2,292,216 | 8/1942 | Doran | 313/135 |
| 2,894,162 | 7/1959 | Ignatjev . | |
| 3,790,842 | 2/1974 | Westenkirchner . | |
| 4,268,774 | 5/1981 | Forkum, Jr. . | |
| 4,659,960 | 4/1987 | Toya et al. . | |
| 5,121,026 | 6/1992 | Patrician . | |
| 5,132,587 | 7/1992 | Lemelson . | |
| 5,408,961 | 4/1995 | Smith | 123/169 R |
| 5,430,346 | 7/1995 | Johnson | 313/141 X |
| 5,430,396 | 7/1995 | Johnson | 313/141 X |
| 5,581,145 | 12/1996 | Kato et al. | 313/123 X |
| 5,612,586 | 3/1997 | Benedikt et al. | 313/141 |

*Primary Examiner*—Sandra L. O'Shea
*Assistant Examiner*—Mack Haynes

[57] ABSTRACT

An internal combustion engine spark plug having an inside annular groove at the end of its shell that accommodates a replaceable ground electrode that consists of a circular wire of durable metal that fits the annular groove and having ends that are pre-formed to terminate adjacent to the peripheral edge of the center electrode providing a double spark gap.

3 Claims, 1 Drawing Sheet

FIG. 1
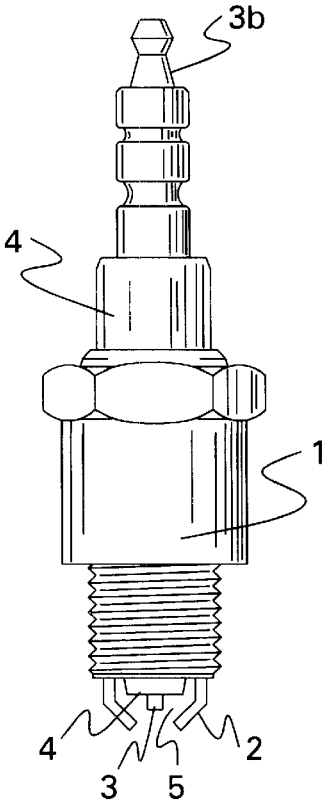
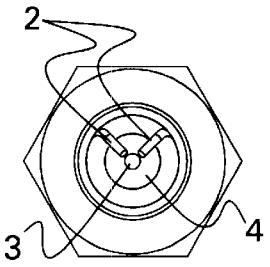
FIG. 3
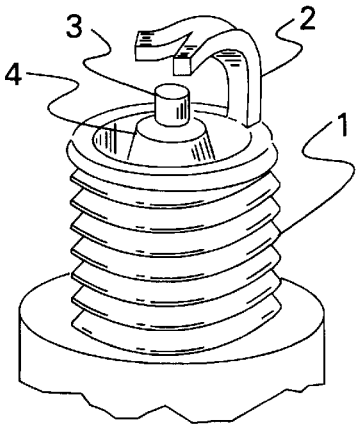
FIG. 6
Prior Art
FIG. 2
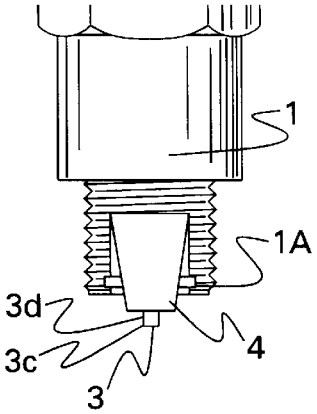
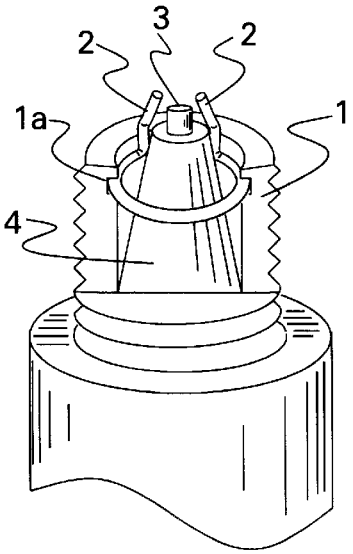
FIG. 4
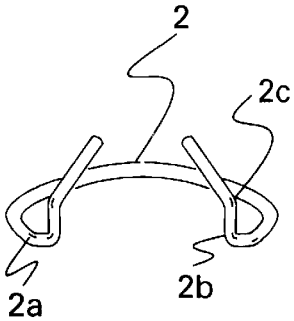
FIG. 5

SPARK PLUG WITH REPLACEABLE GROUND ELECTRODE

CROSS-REFERENCE

U.S. Pat. No. 4,268,774 Forkum Jr., May 19, 1981.

FIELD OF THE INVENTION

The present invention relates to the modification of currently manufactured spark plugs that are used to ignite fuel air mixture in internal combustion engines and more particularly, with the substitution of a replaceable double ended ground electrode for the permanently fixed single ended ground electrode, the design changes being conducive to improved spark performance and practical maintenance of the spark plug.

BACKGROUND OF INVENTION

While there has been some variation of spark plug design over time, the conventional spark plug basically remains the same, being comprised of a cylindrical metal shell whose terminal end is threaded to permit installation and removal at the engine's cylinder head, said shell containing a core insulator that surrounds a center electrode, said core insulator and center electrode extending from the threaded end of shell to the distal end of spark plug, said center electrode projecting through the end of core insulator forming an electrical terminal that is designed to connect with a high tension lead wire. At the proximal end of the spark plug as defined by the threaded end portion of shell, said center electrode projects through the end of core insulator a distance necessary for interaction with the ground electrode, said ground electrode extending from the rim of the shell's end portion parallel to the longitudinal axis of the center electrode, making a 90° bend at a distance that allows the end portion of ground electrode to terminate at right angle beyond and in line with the flat end portion of center electrode defining a suitable spark gap.

By definition a spark plug can be said to be an engine component that provides, within the combustion chamber, a spark gap that conducts high tension electrical energy for the purpose of igniting a fuel and air mixture.

In research it has been noted that electrode design of a spark plug will affect its performance.

With regard to experiments in this area, it is my conclusion that the spark plug itself is a hindrance to the purpose for which it is designed and that the ideal condition for best results would be for a spark to occur centrally within the combustion chamber with no barriers or protrusions of any kind, allowing the flame kernel to propagate equally and undisturbed in all directions throughout the combustion chamber. If this were possible, it would greatly improve engine performance and reduce hydrocarbon emissions. As this will probably never be achieved, it follows that a spark plug design that could at least approximate such a condition should be desired.

In conventional spark plug when viewed from the terminal or sparking end, two blind spots can be observed, that is two areas that are blocked by the ground electrode preventing and deflecting flame travel. One longitudinally outward from the center electrode where the ground electrode is necessarily defining a spark gap but at the same time shadowing the flat end portion of the center electrode blocking and deflecting flame travel. The other is radially where the vertical portion of the ground electrode shadows the vertical end portion of the center electrode blocking and deflecting lateral flame travel. The more bulky and wider the ground electrode, the more pronounced is this effect. It follows that any design that reduces the shadow effect of the ground electrode would be an improvement over prior art.

With regard to prior art, U.S. Pat. No. 4,268,774 in FIG. 6 of drawing sheet shows an improved design of a ground electrode for an otherwise conventional spark plug, the electrode having diverging prongs, that according to the inventor, causes a unique arcing action in the spark gap, resulting in lower carbon monoxide emissions. Tests of this spark plug in an '84 Mazda (4 cyl. Engine) at a certified emission test station with computer print out bears out the inventor's claim as being valid. The same test made using a conventional spark plug with my replaceable double ended ground electrode also registered a reduction of emissions in the computer print out.

SUMMARY OF INVENTION

The object of this invention with regard to prior art is to eliminate the fixed ground electrode. Research and tests seem to indicate that the ground electrode so positioned by its proximity and alignment longitudinally with the center electrode has a baffle effect, impeding flame kernel propagation at the point of ignition.

Modifying the spark plug shell to accommodate a replaceable less bulky double ended ground electrode with its sparking ends positioned relative to the center electrode as explained in detailed description, will result in improvements over prior art in these 3 areas as listed:

1. The electrode design affords a double spark gap, extending electrode life, with sparks over time being divided between two sparking points.
2. Reduces misfire by eliminating the baffle effect, thus allowing for greater exposure of the initial spark to the fuel charge in the combustion chamber.
3. The snap in characteristic of the electrode permits easy removal and replacement for spark plug cleaning and renewal.

BRIEF DESCRIPTION OF DRAWINGS

FIG. 1 Is a front elevation of a spark plug with the replaceable ground electrode and double spark gaps in view.

FIG. 2 Is a cutaway view of FIG. 1 showing annular groove 1A in shell 1.

FIG. 3 Is a bottom end view of FIG. 1.

FIG. 4 Is a cutaway view of the complete configuration of the preferred embodiment.

FIG. 5 Is the pre-formed circular ground electrode.

FIG. 6 Is prior art showing ground electrode having diverging prongs.

DETAILED DESCRIPTION OF INVENTION

Except for the ground electrode and annular groove indicated at 2 and 1A of FIG. 4 in the drawings, the spark plug herein described is conventional being comprised of a cylindrical metal shell whose proximal end is threaded FIG. 1-1, to permit installation and removal at the engine's cylinder head, said shell containing a ceramic core insulator FIG. 1-4 that surrounds a center electrode FIG. 1-3, said insulator and electrode extending from the proximal end of shell as defined by the threaded end portion, through the shell to the distal end of the spark plug, where center electrode extends from extreme end portion of insulator to form an electrical connection FIG. 1-3*b* to a high tension lead wire. At the proximal end of the shell, the center electrode FIG. 1-3 extends from the end of core insulator FIG. 1-4, a distance that permits interaction with ground electrode FIG. 1-2, said ground electrode being in the form of a circular resilient titanium wire FIG. 5-2, that is preformed to fit securely within an annular groove inside the shell FIG. 4-1A, that is premachined for that purpose. If modification by a manufacturer, incorporating these embodiments, machining the shell's annular groove would be done before spark plug assembly. With regard to means and methods in the modification of spark plugs to incorporate the features of my invention, certain considerations should be noted. Size variations in spark plugs marketed today have to be considered in determining a reference diameter dimension for the circular wire, that in turn is used to proportionately determine the width and depth of the annular groove and its relative location within the shell.

Two shell sizes of spark plugs in common use today are the 14 mm and the older 18 mm outside diameters as measured across the threaded end portion of shell. These diameters correspondingly affect the inside diameters of the shells and their wall thicknesses. These factors plus the flexibility and resiliency needed to insure the snap in characteristic of the replaceable ground electrode, are all considered in determining a reference diameter for the circular wire. The circular wire and ground electrode for the purpose of their description are interchangeable terms.

From these considerations an empirical formula can be developed that satisfies the dimension requirements for a successful modification of any size sparkplug once the reference diameter for the circular wire has been established. As for a circular wire length, a more practical method is to clip off excess length after snap in of ground electrode. When the circular wire has been inserted and recessed within the annular groove inside the shell, its inside circular diameter should be 0.014 inches less than the inside diameter of the shell. Therefore the formula is:

Depth of annular groove is equal to reference diameter of circular wire less 0.007 inches. If 0.032 inches is a reference diameter of the circular wire for a 14 mm spark plug then depth of annular groove should be 0.032−0.007=0.025 inches.

The width of the annular groove should be slightly in excess of the reference diameter of the circular wire for a proper fit. If 0.004±0.001 inches has been allowed as a suitable clearance, the formula would be:

Width of annular groove=Reference diameter 0.032+0.004+0.001 inches.

If the edge distance of the annular groove, as measured from proximal end of shell to the leading edge of groove, is determined to be equal to the reference diameter of the circular wire+0.005 inches, the formula would be:

Annular groove edge distance=0.032+0.005 inches.

Steps for modifying a premanufactured spark plug is first to remove its ground electrode at the point of attachment. Using a means to center the plug in a lathe spindle, face off the shell end enough to remove any vestige of the ground electrode. If it is an 18 mm shell there is sufficient clearance for cutting tool entrance between the shell and the core insulator. If it is a 14 mm shell a counterbore is necessary to increase inside shell diameter by 0.040 inches to provide a safe clearance between cutting tool and ceramic insulator.

With the cutting tool having the proper width, a square annular groove is machined to the proper depth FIG. 2-1A at the correct edge distance from shell's terminal end. As is my practice for a 14 mm spark plug, the circular wire is partially preformed on a mandrel, winding a 270° circle on a diameter of 0.265 inches that allows for spring back. Since it is desirable to have the sparking ends of circular wire spaced apart and yet to have a circumference radially sufficient to insure a firm fit of circular wire in annular groove, the choice of a 270° circle allowing for a 90° angular spacing of the electrode free ends with respects to the center electrode, is recommended. Three bends at each end of circular wire are presently hand-crafted to bring sparking ends within gapping distance of center electrode. The first bend being made at the tangent point of wire to the 270° circle FIG. 5-2*a* being bent inward and horizontal to the vertical axis (wherein, the bent portion of the wire forms a 90 degree angle with respects to the vertical axis of the spark plug) of spark plug, clearing the annular groove, allowing for a second bend of 90° FIG. 5-2*b,* that parallels the wire to vertical axis terminating wire end adjacent to peripheral edge of center electrode. A final bend of 45° FIG. 5-2*c* to vertical axis, adjusts the angle and spark gap setting, so that a spark is predisposed to occur 45° to the vertical axis between the sparking end of the circular wire and the peripheral edge FIG. 2-3*c* of the extreme end portion of center electrode, peripheral edge being defined as the sharp circular edge that is formed by the flat bottom end of center electrode FIG. 2-3 interfacing with the peripheral side surface of center electrode FIG. 2-3*d.*

The angle feature of the linear spark is important in my view for 2 reasons. Theoretically, if spark direction is horizontal, vertical flame travel will be at the expense of horizontal flame travel. If spark direction is vertical, horizontal flame travel will be at the expense of vertical flame travel, therefore the linear spark being at a 45° angle will equalize the effect. Moreover, the spark angle predisposes the spark to impinge at the sharp peripheral edge of center electrode FIG. 2-3*c* resulting in a semi-circle of fire around said circular edge providing additional ignition power. The phenomenon may be explained by an electrical law that says, "Current always seeks the path of least resistance". Therefore, the spark at the point of impingement with the sharp circular edge meets with high resistance and races around the edge lowering the resistance and effecting the discharge.

In the conventional spark plug, the spark impinges centrally on the flat end surface of center electrode, that offers less resistance than the peripheral edge and accordingly does not produce the fire racing effect around the circular edge as does a spark that impinges at the peripheral edge.

I claim:

1. A spark plug for igniting a fuel charge of an internal combustion engine, being comprised of a metal shell containing a ceramic insulator that surrounds an elongated center electrode, said electrode extending axially through and beyond one end of said insulator to form an electrical terminal for connection with a high tension ignition lead wire, said electrode extending axially through opposing end of said insulator so that tip portion of said electrode is in close proximity to a double ended replaceable ground electrode, said ground electrode being in the form of a circular 270° resilient titanium wire having a reference diameter and preformed to fit within an annular groove, having a width and depth, located inside the threaded end portion of said shell, said circular wire's mid portion being seated within said annular groove with free ends having 3 consecutive bends starting from tangent points of said 270° circular wire consecutive bends of 90°, 90° and 45° so that the sparking ends are outside the peripheral limits and longitudinally beyond the flat end of said center electrode, forming the shape of said free ends so that spark gaps are defined at an angle of 45° to longitudinal axis of said center electrode predisposing linear sparks from the sparking ends of said circular wire to impinge at the sharp circular edge of the extreme end portion of said center electrode, wherein the said 270° circular portion of said wire as well as said annular groove allows said free ends of said circular wire to have an angular spacing of 90° with respects to said center electrode.

2. The spark plug defined in claim 1 wherein said reference diameter of the circular wire correspondingly, with allowable tolerances, determines the width, depth and relative location of said annular groove within said shell.

3. The spark plug defined in claim 2 wherein said reference diameter of said circular wire is dependent upon spark plug shell size and the flexibility needed for the snap in action of said replaceable ground electrode, wherein said reference diameter of the circular wire and the location of its free ends with respect to said center electrode are controlling factors in reducing the shadow effect of said ground electrode.

* * * * *